United States Patent [19]

Leckie

[11] 3,943,657

[45] Mar. 16, 1976

[54] TOY FLYING MACHINES

[76] Inventor: Robert Malcolm Paul Leckie, 33 Halford Road, Richmond, Surrey, England

[22] Filed: Oct. 4, 1973

[21] Appl. No.: 403,412

[30] Foreign Application Priority Data

Oct. 4, 1972 United Kingdom ..... 45789/72
Mar. 5, 1973 United Kingdom ..... 10479/73

[52] U.S. Cl. ..... 46/80
[51] Int. Cl. ..... A63h 27/00
[58] Field of Search ..... 46/79, 80; 244/DIG. 1

[56] References Cited

UNITED STATES PATENTS

| | | | |
|---|---|---|---|
| 2,158,377 | 5/1939 | O'Hare | 46/80 |
| 2,306,866 | 12/1942 | Crary | 46/79 |
| 2,765,582 | 10/1956 | Hurtado | 46/80 |
| 3,380,189 | 4/1968 | O'Millian | 46/80 |
| 3,408,767 | 11/1968 | Anderson | 46/80 |
| 3,654,729 | 4/1972 | Imperato | 46/80 |

*Primary Examiner*—Louis G. Mancene
*Assistant Examiner*—Robert F. Cutting
*Attorney, Agent, or Firm*—Cushman, Darby & Cushman

[57] ABSTRACT

A toy flying machine is capable of operating in two regimes, in one of which the wings are retracted and so produce a reduced air resistance and in the other of which the wings are outstretched so that the machine operates as a glider. The first regime is used for launching and the second represents normal flight. The wings are biassed to their outstretched positions and are held aerodynamically or mechanically against the bias until the machine has gained height when the wings are released.

7 Claims, 9 Drawing Figures

FIG. 1
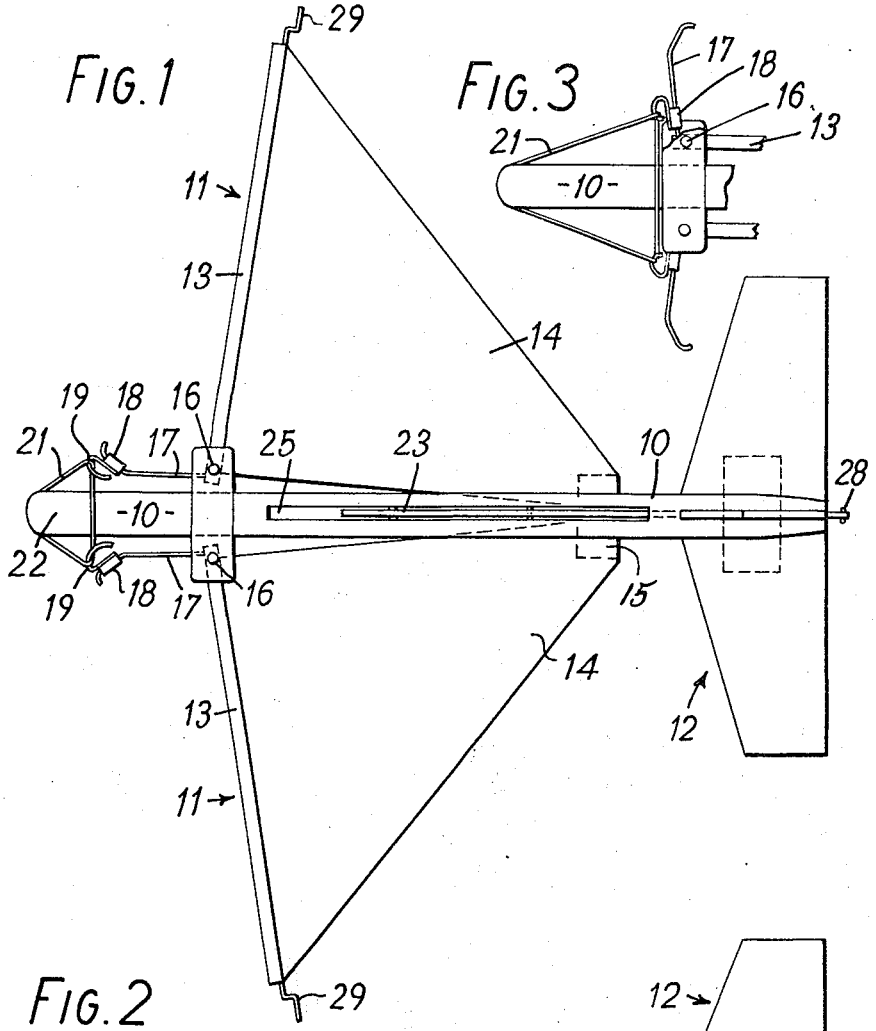
FIG. 3
FIG. 2
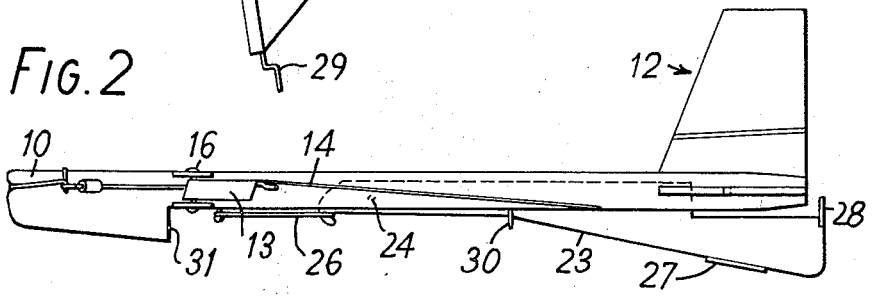
FIG. 4
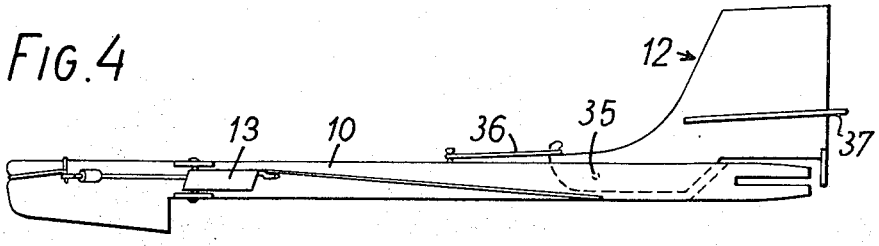

TOY FLYING MACHINES

This invention relates to toy flying machines, in particular to a glider which can be fired into the air like a rocket.

Great pleasure is derived from watching a device floating slowly down from a great height; the difficulty lies in getting the device to that height in the first place. The physical characteristics required for floating or gliding down are the opposite of those required to allow a device to be projected to a substantial height.

The invention aims to provide a toy flying machine which can adopt a relatively more streamlined shape which allows it to be projected to a height, and a relatively less streamlined shape which allows it to glide slowly down again.

There is therefore proposed a toy flying machine having a fuselage and wings, or at least part thereof, which are hinged to the fuselage and movable between their operative positions and retracted positions in which they present a reduced air resistance, the machine further including means operable while the machine is in flight for moving the wings from their retracted positions to their operative positions.

For holding the wings temporarily in their retracted positions the said means may comprise surfaces on the wings for aerodynamically producing a force temporarily holding the wings against a bias, or they may comprise mechanical means for producing such a force mechanically. The mechanical means may themselves be aerodynamically controlled to hold and release the wings.

The invention will now be described with reference to the accompanying drawings, which show a number of exemplary embodiments thereof:

FIG. 1 shows a top plan view of a first form of toy flying machine;

FIG. 2 shows a side elevation of the machine of FIG. 1;

FIG. 3 shows a scrap view of a spring mechanism acting on the foldable wings in the folded state;

FIG. 4 shows a side elevation similar to FIG. 2, but having a different means of latching and releasing the wings;

Figure 6:
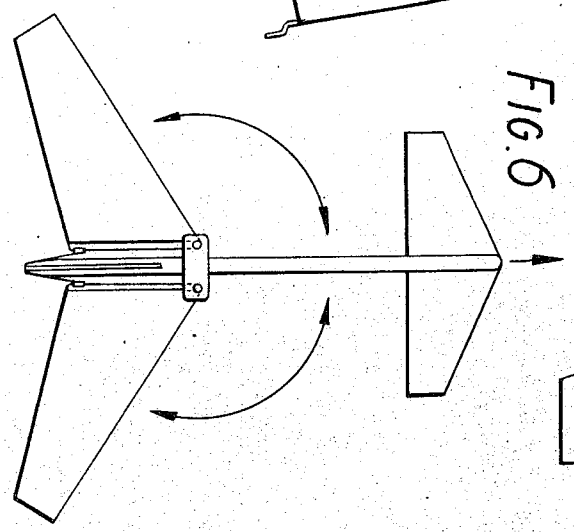
Figure 7:
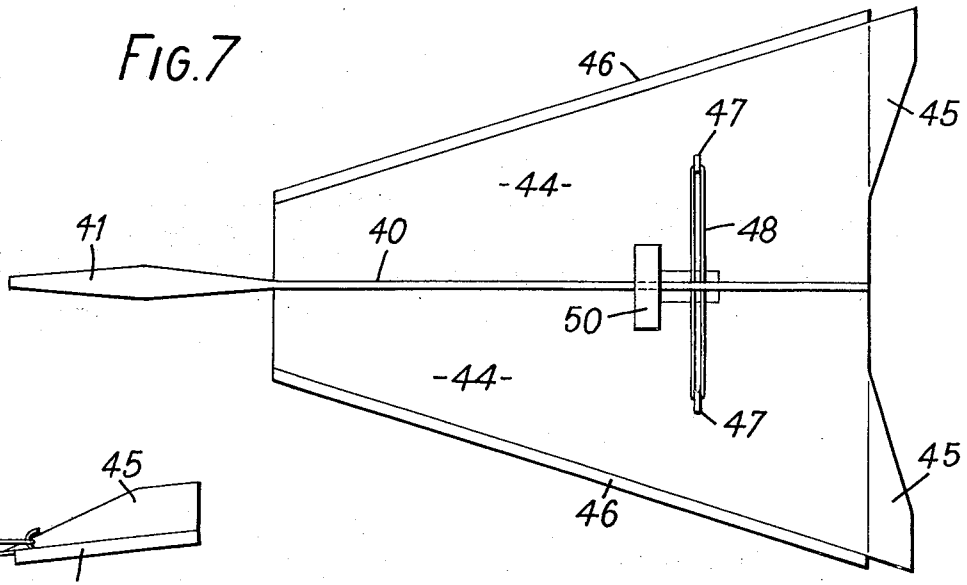
Figure 8:
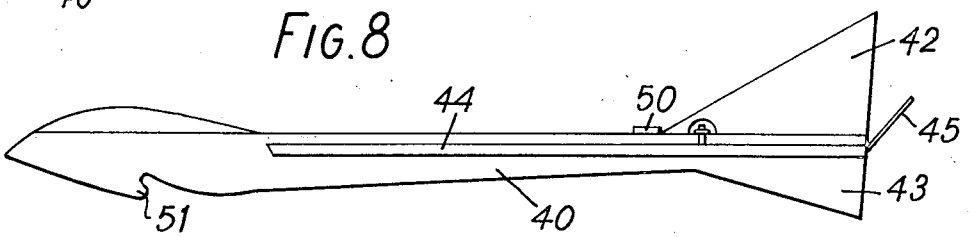

FIG. 6 similarly shows a third machine;

FIG. 7 similarly shows a fourth machine;

FIG. 8 shows a side elevation of the machine of FIG. 7; and

Figure 9:
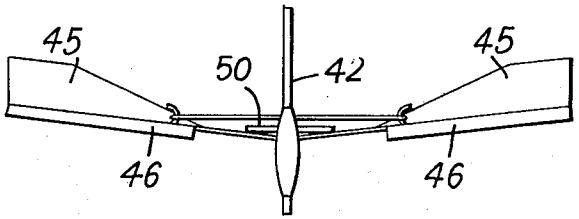

FIG. 9 shows a front elevation of the machine of FIG. 7.

A plan view of a glider is shown in FIG. 1. The glider has a fuselage 10, wings 11 and a rigid tailplane 12. Each wing 11 comprises a rigid bar 13 forming a leading edge, and an aerofoil surface 14 formed by a flexible sheet material, such as polythene, woven 'terylene', 'melinex' or tissue paper. Preferably the material is air impermeable. It is fixed along the whole length of the bar 13 and at suitable points along the fuselage, in particular to projecting surfaces 15 on the fuselage.

Each bar 13 is mounted at one end on a pivot pin 16 held between two projecting plates on the fuselage 10. This allows the wing 11 to pivot from the extended position shown to a folded position in which the bar 13 lies substantially parallel to the fuselage with the flexible sheet material collapsed.

A short lever arm 17, preferably of spring wire, is rigid with bar 13. A sleeve 18 with a hook 19 attached thereto is slidable on the arm 17. An elastic band 21 extends around the hooks 19 associated with both wings and the nose 22 of the fuselage. The band 21 retains the wings 11 extended as shown.

As seen in FIG. 2, a rearwardly projecting lever 23 is mounted on a pivot pin 24. Conveniently, the lever 23 is largely housed in a slot 25 in the fuselage.

The lever is biassed to pivot clockwise in FIG. 2 by an elastic member 26. Toward its rear end, the lever 23 carries a small wing structure 27, and at its very end two upwardly projecting pins forming a latch 28.

Each bar 13 has at its end furthest from the fuselage a projecting pin 29.

A wire loop 30 limits the downward movement of the lever 23.

When the wings 11 are folded back, the pins 29 come to lie together just beyond the rear end of the fuselage. By lifting the lever 23 against its bias, the pins 29 can be held between the pins of the latch 28, thus retaining the wings folded. However, some external force is required to hold the lever 23 against its bias.

In this folded state, the wings 11 offer minimal air resistance and the glider can be projected into the air somewhat like a dart or rocket. For example, a capapult engaging behind a shoulder 31 on the fuselage may be used. So long as the glider is still held in the hand, latch 28 can be prevented from releasing the wings 11. Once the glider is projected forwards, air pressure acts on the wing structure 27 to counteract the bias of the elastic member 26, and the wings remain folded so long as the forward motion remains fast enough.

Once the momentum of the initial projection is dissipated, as the glider reaches its apogee, the air pressure drops, allowing the lever 23 to drop and release the pins 29 on the wings. These are subject to the bias of the elastic band 21 (see FIG. 3), and they are therefore caused to pivot forwards, thus extending the aerofoil surfaces 14 formed by the flexible material. From then on, the glider can float slowly back to earth.

A comparison of FIGS. 3 and 1 shows that, in the folded state of the wings, the sleeves 18 lie close to the pivot pins 16, while with the wings extended they lie towards the free ends of the arms 17. This is an advantageous arrangement because in the folded state, the moment of the force exerted by the elastic band 21 is smaller than when the wings are extended. It is necessary that the outward forces exerted by the pins 29 on the latch 28 should not be too great since otherwise the friction between them may be too great to allow satisfactory release. On the other hand, when extended, the wings need to be retained with some force so that the flexible material does not become slack.

In practice, the balance of forces between the elastic band 21, the elastic member 26, the air pressure on the wing structure 27, and gravity acting on the lever 23, is a matter of some subtlety, but can be determined without much difficulty by experiment.

FIG. 4 shows an alternative arrangement for latching the wings in the folded state. In this case, the whole tailplane 12 is made pivotable about a pin 35 and is biassed by an elastic member 36. Operation is similar to that described above; air pressure on the wings 37 of the tailplane holds the latter down against the bias until forward motion slows sufficiently.

In the machine described above in relation to FIGS. 1 to 4 the temporary holding of the wings in their retracted positions and their later release is effected mechanically, under aerodynamic control by the members 27, 37.

Figure 5:
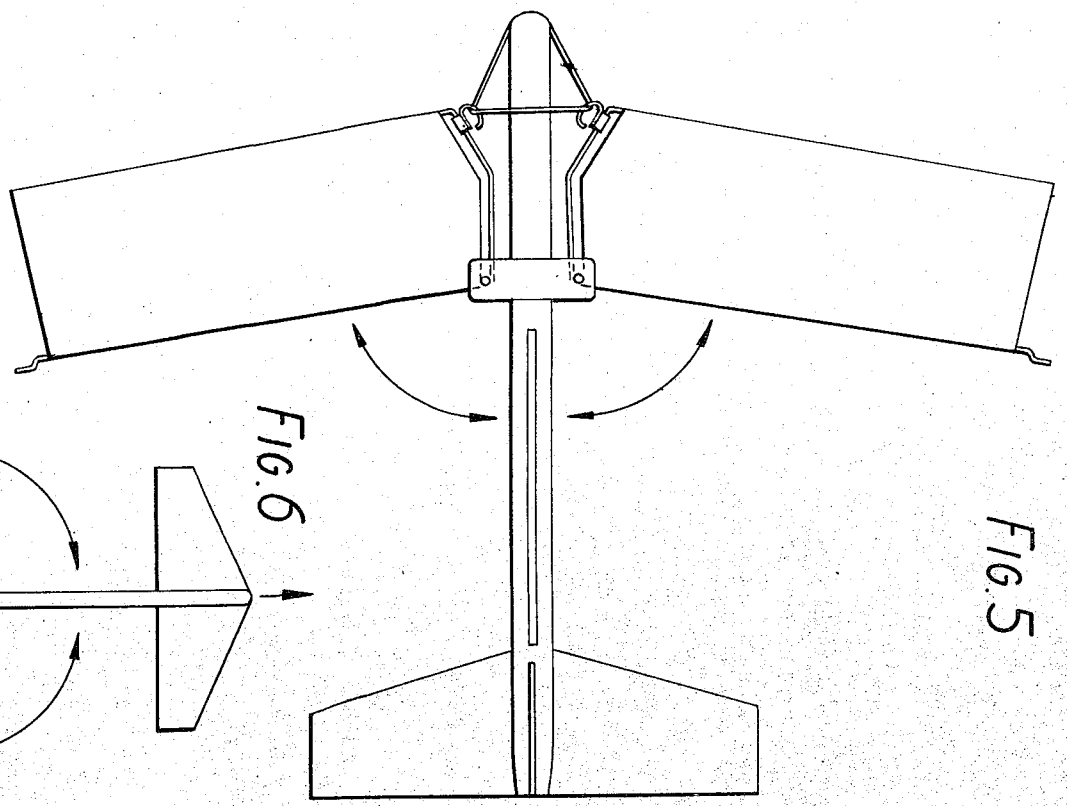
FIG. 5 shows a top plan view of a second form of toy flying machine.

FIG. 5 shows an arrangement with solid wings pivoted at their trailing edges. Operation is otherwise precisely as described for the glider of FIG. 1, except that the air resistance with the wings folded may not be as small. Any of the described means of latching the wings may be employed.

FIG. 6 shows a 'canard' glider, with the tailplane at the forward end. The wings fold forwards instead of backwards, but analogous latching means are employed.

Although the embodiments so far described have included mechanical means for holding the wings in their retracted positions against a bias and releasing them for normal flight, it is possible to effect the temporary holding of the wings against a bias directly, by the use of aerodynamically effective surfaces provided on the wings. The embodiment now to be described with reference to FIGS. 7 to 9 illustrate this possibility.

Referring now to those Figures, the fourth machine embodying the invention comprises a fuselage 40 formed of a plastic strip weighted at its front end 41 and at its rear end providing a tailplane 42 and a landing skid 43.

Sheet plastics wings 44 are attached to the fuselage 40 along either side so as to be foldable together downwardly. Conveniently the wings have downturned edge portions (not shown) at which they are stuck to the fuselage and which are integrally joined to the wings 44 proper along lines of weakening, e.g. by reduced thickness.

The wings have upwardly turned rigid wing flaps 45, 46 along their rear and side edges respectively. The purpose of these flaps which later become apparent.

Anchorages 47 are provided at the upper surface of each wing for an elastic band 48 which extends across the top of the fuselage so as to bias the wings upwardly. These anchorages may be provided by specially provided members as shown, or, alternatively, by arcuate ears created by crescent-shaped slots formed in the sheet plastics material of the wings 44 concave to the fuselage 40.

A stop member 50 centrally stuck to the top edge of the fuselage provides a positive limit to the upward pivoting movement of each wing 44 under the action of the elastic band 48. When the wings engage the member 50 at its ends the elastic band is still under tension.

For operation the wings 44 are folded downwardly together, and held by hand at their then bottom rear corners. The flaps 45 then extend from their roots outwardly of one another, whereas the flaps 46 extend inwardly. A catapult is engaged in a hook 51 provided by the fuselage 40 at the front end 41, and the wings are released to allow the machine to be projected by the catapult somewhat like a dart or a rocket.

When the machine is projected forwards in this manner, air pressure acts on the surfaces of the wing flaps 45 presented to the air stream, so as to counteract the bias of the elastic band 48; the wings therefore remain folded together so long as the forward motion remains fast enough. During this time the wings 44 offer minimal air resistance, so that a considerable height may be achieved.

Once the momentum of the initial projection is substantially dissipated, as the machine reaches its apogee, the air pressure on the flaps 45 drops and the wings are allowed to pivot upwardly relative to the fuselage under the action of band 48. The machine can thereafter float slowly back to earth with the wings 44 in their operative positions, in which they abut the stop members 50.

In practice, the balance between the force exerted by the elastic band 48 and the aerodynamic forces acting on the flaps 45 is a matter of some subtlety, but can be determined without much difficulty.

The flaps 46 along the edges of the wings are solely to improve stability and glide characteristics.

In a modification of the arrangement of FIGS. 7 to 9 the elastic band 48 and associated anchorages 47 are omitted, and the wings 44 are biassed upwardly at their attachments at the fuselage. Preferably the attachments themselves are of a resilient material which provides the necessary biassing force.

The material for the wings and fuselage of a machine in accordance with the invention may be chosen from wood (in particular, balsa wood and plywood), plastics, and metal.

The whole machine may be provided in kit form for assembly by a purchaser, since there are few parts, which are readily assembled.

In a particular modification of the arrangement shown in FIGS. 1 to 3, rings are used to replace the sleeves 18 and their associated hooks 19. In the arrangement of FIG. 4 it may be necessary or desirable to provide additional wings on the tail plane 12 for increasing the force opposing the biassing force produced by the member 36 during launching. These additional wings may be mounted above the wings 37.

It will be understood that the above description of the present invention is susceptible to various modification changes and adaptations.

What I claim is:

1. A toy flying machine comprising a fuselage, a plurality of wings, each of said wings including a rigid front bar forming a leading edge thereof, and flexible sheet material attached to said bar and to said fuselage and for providing an aerofoil surface for the wing in operative position thereof, means for pivotally mounting said bars of said wings to said fuselage so that they are movable between an operative position wherein said flexible sheet material provides an aerofoil surface and maximum gliding of the machine is possible, and a retracted position wherein said flexible sheet material is folded up and minimum machine air resistance is provided, biasing means for exerting a biasing moment on said wings which is less in said retracted position than during pivoting of said wings toward operative position, and means subject to aerodynamic pressure dependent upon the forward motion of the machine for controlling movement of said wings between said retracted and said operative positions.

2. A toy flying machine comprising a fuselage, a plurality of wings, means for pivotally mounting said wings to said fuselage so that they are movable between an operative position wherein maximum gliding of the machine is possible, and a retracted position wherein minimum machine air resistance is provided, biasing means for exerting a biasing moment on said wings which is less in said retracted position than the moment exerted therby during thereby of said wings toward said operative position from said retracted position, said means comprising, for each wing, a rod member attached to the wing and a collar slidable along said rod member, and elastic means biasing said collars toward one another so that said wings may be moved from their retracted to their operative position by sliding movement of said collars along said rod members, and means subject to aerodynamic pressure dependent upon the forward motion of the machine for controlling movement of said wings between said retracted and said operative positions.

3. A machine as recited in claim 2 wherein said elastic means comprises an elastic band linking said collars to one another and to said fuselage.

4. A toy flying machine comprising a. a fuselage having a pair of generally vertically extending side surfaces, and a top and a bottom, b. a plurality of wings, c. means for pivotally connecting said wings to said fuselage so that they are movable from a retracted position wherein they extend downwardly generally against said fuselage side surfaces and in which position minimum air resistance is provided and in which position they are disposed during initial flight movement, and an operative position wherein said wings extend generally horizontally and wherein maximum gliding of the machine is possible, d. biasing means for biasing said wings from said retracted position toward said operative position, and e. aerodynamic means formed on said wings for holding them in said retracted position against the bias of said biasing means during initial movement of said machine in flight, but allowing movement of said wings under the influence of said biasing means toward said operative position thereof after said machine has generally reached its flight apogee.

5. A machine as recited in claim 4 wherein said aerodynamic means comprises a flap formed on each wing and extending generally upwardly therefrom.

6. A machine as recited in claim 5 further comprising stop means formed on said fuselage and extending generally horizontally for limiting the upward movement of said wings into said operative, generally horizontally extending position thereof.

7. A method of flying a toy flying machine, said machine comprising a fuselage having a pair of vertically extending side surfaces and a top and a bottom, a plurality of wings, means for pivotally connecting said wings to said fuselage so that they are movable from a retracted position wherein they are held extending generally downwardly generally against said fuselage side surfaces and an operative position wherein they extend generally horizontally, biasing means for biasing said wings from said retracted position toward said operative position, and aerodynamic means formed on said wings for holding them in said retracted position against the bias of said biasing means during initial movement of said machine in flight but allowing movement of said wings under the influence of said biasing means toward said operative position thereof after said machine has generally reached its flight apogee, said method comprising the steps of manually folding said wings downwardly to said retracted position thereof, launching said machine by applying a forwardly directed force thereto, and releasing hold of said wings in said downwardly extending retracted position thereof simultaneously with the launching of said machine, said wings remaining in their retracted position under the influence of said aerodynamic means until the apogee of the machine flight is generally reached, whereat said wings will move to their operative position under the influence of said biasing means and remain there during the remainder of machine flight.

* * * * *